United States Patent [19]

Hughes, Jr.

[11] 4,294,051

[45] Oct. 13, 1981

[54] MODULAR BUILDING SYSTEM

[76] Inventor: William J. Hughes, Jr., 2100 College Dr., Baton Rouge, La. 70808

[21] Appl. No.: 40,878

[22] Filed: May 21, 1979

[51] Int. Cl.[3] ..... E04C 1/08; E04C 1/28

[52] U.S. Cl. ..... 52/98; 52/90; 52/228; 52/585; 52/807

[58] Field of Search ..... 52/90, 98, 227, 228, 52/585, 785, 807

[56] References Cited

U.S. PATENT DOCUMENTS

| | | | |
|---|---|---|---|
| 683,195 | 9/1901 | Beam | 52/227 X |
| 683,442 | 10/1901 | Cooley | 52/585 |
| 1,320,882 | 11/1919 | Maehler . | |
| 1,375,402 | 4/1921 | McAvoy . | |
| 1,397,976 | 11/1921 | McAvoy | 52/227 |
| 1,734,771 | 11/1929 | Mitchell | 52/227 |
| 1,831,897 | 11/1931 | Wagner | 52/228 |
| 2,040,578 | 5/1936 | Venzie . | |
| 2,048,279 | 7/1936 | Merritt | 52/785 X |
| 2,087,958 | 7/1937 | Allen . | |
| 2,138,913 | 12/1938 | Fotsch | 403/303 |
| 2,241,169 | 5/1941 | Yokes | 52/228 |
| 2,751,776 | 6/1956 | Streblow et al. | 52/228 |
| 2,803,056 | 8/1957 | Kofahl . | |
| 3,457,698 | 7/1969 | Albers | 52/225 |
| 3,742,665 | 7/1973 | Henry et al. | 52/585 |
| 3,898,779 | 8/1975 | Tracy | 52/90 X |
| 4,067,165 | 1/1978 | Timmons | 52/585 |

*Primary Examiner*—Alfred C. Perham
*Attorney, Agent, or Firm*—Donald L. Johnson

[57] ABSTRACT

A modular building system for residential and light commercial construction is disclosed in which the exterior walls and , optionally, the floor, ceiling, roof and interior walls of the structure comprise a series of like prefabricated rectangular or square panels and subdivisions thereof. Interposed between adjacent panels are relatively thin metal fins somewhat wider than the thickness of the panels so that portions of the fins project beyond the surface of the panels. Within the panels are a plurality of horizontal passages, preferably uniformly spaced, which align with holes in the fins and like passages of adjacent panels. Rigid load transferring members, some or all of which are hollow, are snugly fitted into holes in the fins and extend partially into and snugly fit the aligned passages of the panel on each side of the fin. Integrating means in the form of metal cable or rod extend the length of the wall, floor, ceiling, roof and interior walls, as the case may be, passing through said passages in the panels and through the hollow load transferring members. The panels and fins are held in a state of compression by post-tensioning the several integrating means which are anchored at each end of the wall, ceiling, roof and interior walls, as the case may be.

5 Claims, 9 Drawing Figures

MODULAR BUILDING SYSTEM

SUMMARY OF THE INVENTION

The invention relates to a modular building system in which substantially all of the basic elements used to construct the building are fabricated prior to transporting to the construction site. Each of the individual elements used in the system is composed of standard construction materials such as plywood or fiberboard sheet, cement asbestos board, wood strips or non-combustible cementitious material, metal cable or rod, metal pipe and thin metal strips of varying width. Each of the elements is relatively light in weight and in their prefabricated unassembled form can be transported to the building site and assembled rapidly with relatively unskilled two- or three-man crews using only hand and portable power tools. The unique combination of elements which comprises this modular building system permits the construction of residential or light commercial buildings which meet the strength requirements of conventional building codes. The panels, which may be either rectangular or square, are also so constructed that they can be cut or subdivided between two opposite edges along any line parallel to said edges so as to expose an edge identical to the edges of the un-cut panel thus permitting maximum flexibility for dimensioning the structure. The panels are also constructed such that they can be cut or subdivided at predetermined intervals along a line parallel to the other two opposite edges so as to expose an edge identical to said edges of the un-cut panel, thus affording further dimensional flexibility. This unique feature permitting the panels to be subdivided in both directions also allows the the panels to be cut so as to provide openings for doors and windows. Thus it is not necessary in the system of this invention to prefabricate panels of different sizes and configurations as is frequently required in prefabricated construction. In the system of this invention it is also not necessary to erect a skelton frame for structural strength since load-bearing walls of adequate strength are provided by the unique integrated arrangement of the panels, fins, load transferring members and post-tensioned integrating means. The system permits the erection of conventional single and multi-storied buildings as well as buildings having other structural shapes such as, for example, "A" frame and poly-planer silo-type structures.

The basic elements of the system include a multiplicity of like panels having skins of plywood, fiberboard, or cement asbestos board secured to several parallel pairs of internal transverse members, the transverse members preferably being of identical cross-sectional configuration. Each pair of transverse members defines an internal horizontal passage from one edge of the panel to the other such that in their assembled relationship the passages of adjacent panels are in alignment. When erecting a wall relatively thin metal fins are positioned between adjacent panels and are provided with holes which are in alignment with the horizontal passages of the panels. The metal fins, which are preferably fabricated from mild steel, have greater strength, especially shear strength, than the panels. In order to transfer some of the shear load from the panels to the interposed fins rigid load-transferring members, some or all of which are hollow, such as short lengths of metal pipe, are snugly positioned in the fin openings and extend partially into and snugly fit the aligned passages of each adjacent panel. A series of panels and fins are held together as an integrated wall by two or more integrating means, preferably metal cable or rod, which pass through the aligned passages in the panels and the load transferring members and are anchored at each end of the wall after being placed in tension so as to maintain the assembled panels and fins under compression in the horizontal direction. The floor, ceiling and each pitch of the roof of the building may likewise be constructed using panels and fins which are identical to and interchangeable with the panels and fins used to construct the walls. Each of the metal fins has a width greater than the thickness of the panels so that portions of fins project beyond the surface of the panels. This permits the attachment of auxiliary strengthening members, preferably strips of mild steel, to the projecting portions of the fins so as to augument the strength of the fins as the requirements of the building may dictate. The projecting portions of the fins are also used in attaching the walls to the floor and ceiling, and in attaching the roof to the exterior walls and to the perimeter of the ceiling.

BRIEF DESCRIPTION OF THE DRAWINGS

The detailed description of the invention will be made with reference to the accompanying drawings upon which like numerals designate corresponding parts in the several figures. In the drawings.

DETAILED DESCRIPTION OF PREFERRED EMBODIMENTS

Figure 1:
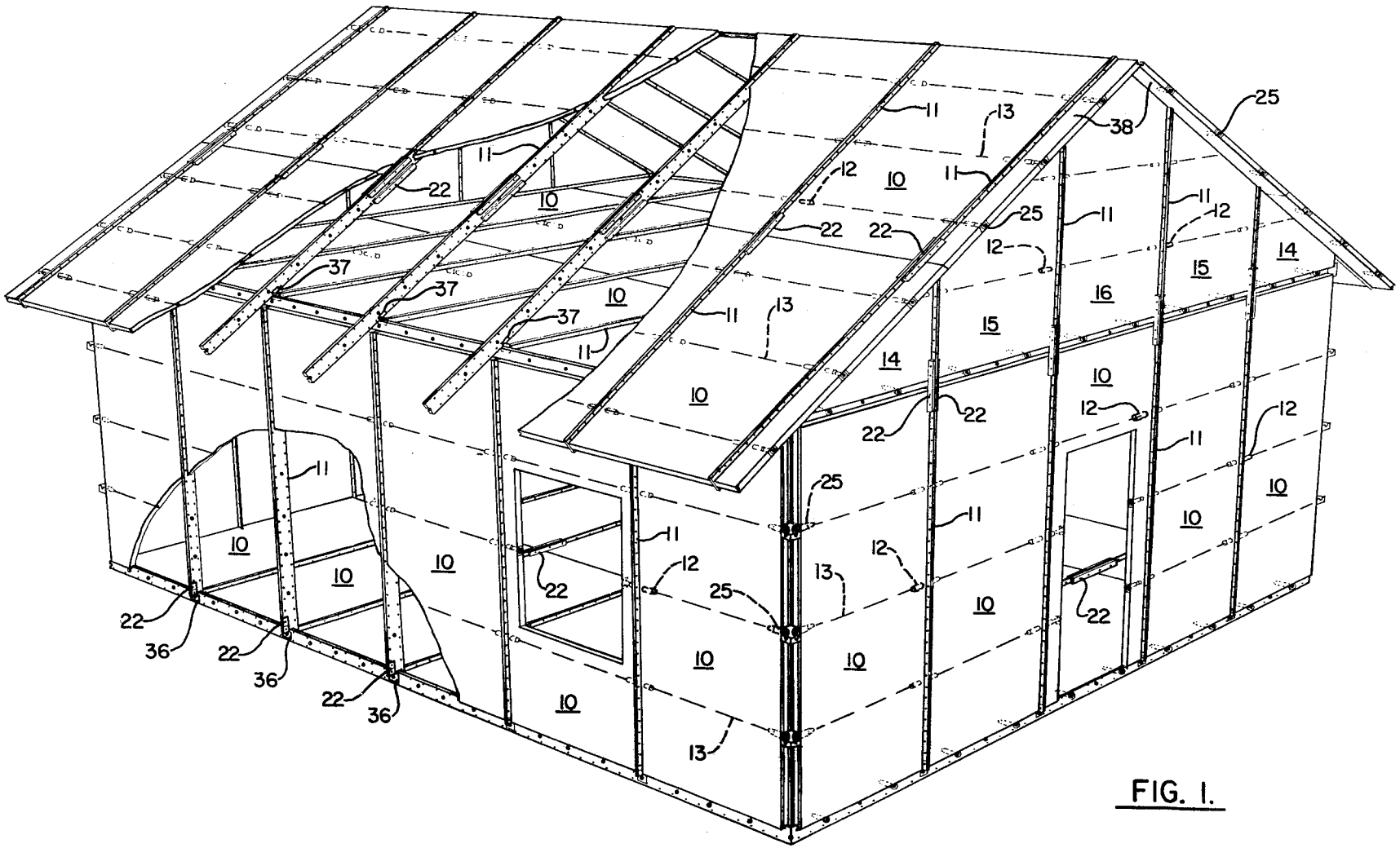
FIG. 1 is a perspective view, partially cutaway, illustrating a building constructed in accordance with the building system of this invention.

FIG. 1 illustrates a building constructed in accordance with this invention in which the exterior walls, floor, ceiling and roof are composed of a series of like panels 10. Interposed between each adjacent panel is a flat, relatively thin metal fin 11. Each of the panels 10 and the metal fins 11 are provided with a multiplicity of horizontal passages and holes respectively, the passages of each adjacent panel being in alignment and also being in alignment with holes in the fins 11. Load transferring members 12, preferably in the form of a short length of metal pipe, are positioned as hereinafter described in various holes of each fin 11 and project partially into the horizontal passages of each adjacent panel 10. The members 12 are sized so that they fit snugly in both the holes of the fin and passages of the adjacent panels. Positioned within the horizontal passages of the panels 10 and passing through the load transferring members 12 are a plurality of integrating means 13, some which extend continuously between the ends of each wall. Like integrating means are positioned within the panels of the ceiling, floor and each pitch of the roof. The integrating means 13 may be a metal rod, flexible metal cable, or stranded wire rope, either of the latter being preferred. The integrating means 13 are anchored at each end of each wall, at each end of a roof pitch and at the ends of the floor and ceiling in a state of tension so as to maintain the panels 10 and fins 11 in compression. In the walls at openings cut in the panels 10 for doors and windows, the integrating means 13 which intercept the openings are anchored at the frame of the openings. To provide the structure of the facade above the walls and below the roof, panels identical to the panels 10 are merely cut at appropriate angles so as to provide subdivisions 14, 15, and 16 of the basic panel. As illustrated in FIG. 1, load transferring members 12 are utilized in panels 14, 15, 16 and the interposed fins 11 in the same manner as in the panels 10 of the walls, floor, ceiling and roof. A grooved finishing strip as hereinafter described is inserted and secured between the skins of cut panels 14, 15 and 16 along the angle of each cut so as to provide means for attaching the cut panels to a fin 11 of the roof against which the cut panels abut. This operation is easily performed at the construction site. Door and window openings are provided by simply cutting the desired openings in a panel 10 and again this can be done at the construction site. As hereinafter explained, the panels 10 can be cut along any line normal to the horizontal passages within the panel and the exposed edge will be identical to the edge of the uncut panel. The panels 10 can also be cut along the center lines of the horizontal passages so as to expose an edge identical to the edges of the uncut panel parallel to the passages.

Figure 2:
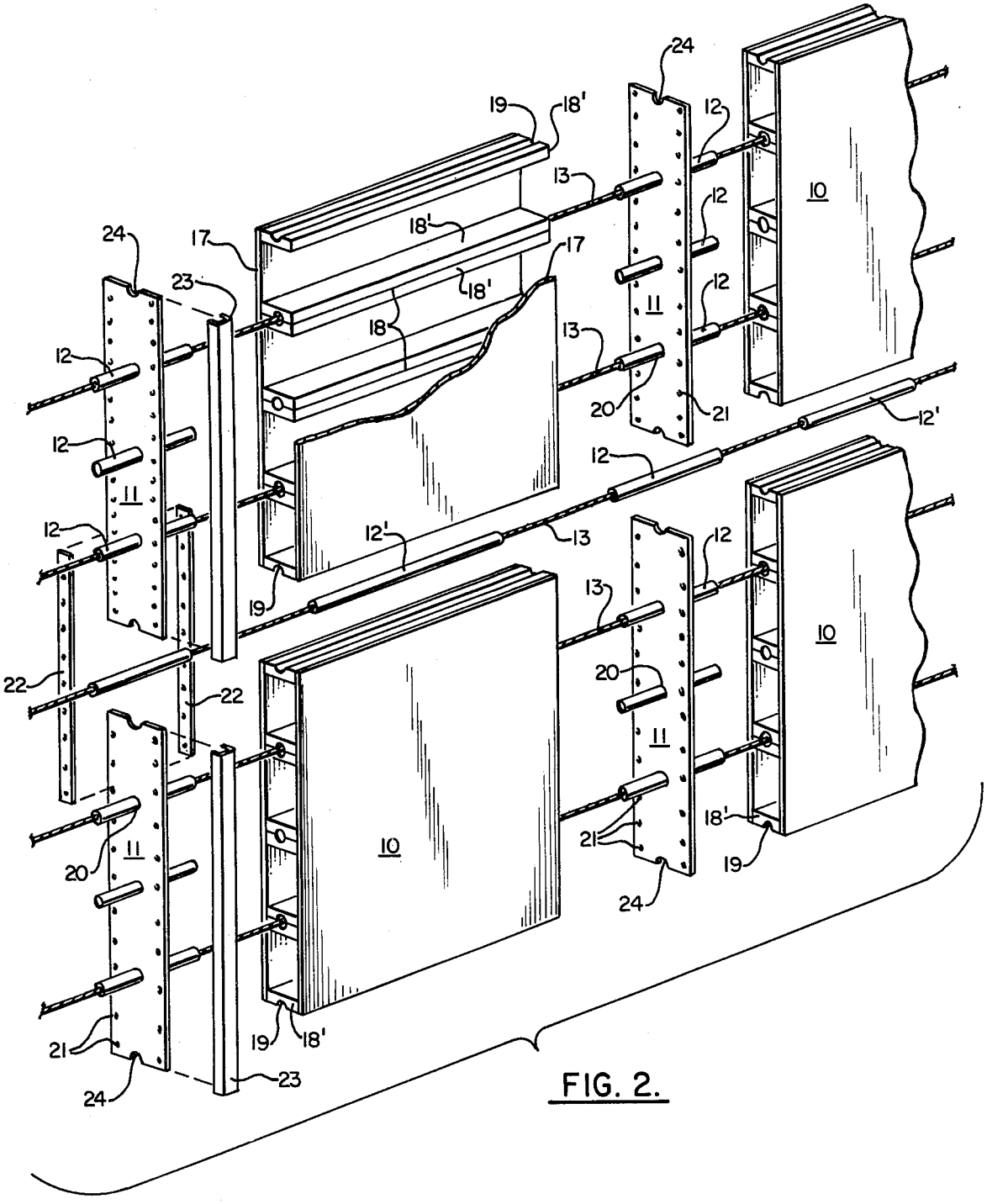
FIG. 2 is an exploded view in perspective illustrating the manner in which the basic elements of the building system of this invention are assembled to form a wall structure.

FIG. 2 is an exploded view in perspective showing the assembled relationship of the panels 10, fins 11, load transferring members 12, and integrating means 13 to form a wall of a building constructed in accordance with this invention wherein the height of the wall is equivalent to the height of two panels 10. These basic elements, of course, will have the same assembled relationship in a wall equivalent in height to the height of one panel 10 as shown in the building of FIG. 1. FIG. 2 also illustrates the structural details of the one embodiment of panels 10.

Referring to FIG. 2, each of the like panels 10 have skin members 17 which form the exterior surfaces of the panel, and are preferably fabricated from either plywood or fiberboard. While the actual dimensions of the panel 10 are not critical, and the panels can be either rectangular or square, one of the advantages of the building system of this invention is that standardized stock items available at most lumber and building supply centers may be employed in constructing the panels, and hence, 4'×8' plywood sheet is ideally suited as the material for the skins 17. Positioned horizontally within the panel 10 and preferably, though not necessarily, spaced at uniform intervals are a series of pairs 18 of like wood strips 18'. As shown in FIG. 2 each pair 18 of wood strips 18' comprise internal transverse members of panel 10 and extend the entire width of the panel. A single wood strip 18' is positioned between the skins 17 at the two edges of the panel parallel to the pairs 18. A generally semi-circular groove 19 is provided in one surface of each of the strips 18' and extends the full length of the strip so that the strip will be of uniform cross-sectional configuration throughout its length. As assembled in the panels the grooved surfaces of the strips 18' are arranged in a mating relationship to form the pairs 18 so that, by means of grooves 19, each pair 18 defines a passage extending continuously between the edges of the panels 10. As referred to above, it is preferable that the pairs 18 be positioned at uniform intervals within the panel, and although the actual spacing is not critical, in the preferred form of this invention the pairs 18 are spaced so that the center lines of the passages defined by the grooves 19 are at one or two foot intervals. The skins 17 and the strips 18' are preferably held in their assembled relationship by adhesive. Although not shown in FIG. 2, it is preferred that as the panel 10 is constructed the space between the pairs 18 be filled with thermal insulating material such as rockwool, fiberglass, or the like.

In the panels 10 of FIG. 2 one can use solid wood strips in place of the pairs 18, in which case a hole is drilled through the length of the strip to provide a continuous passage between the edges of the panel equivalent to that provided by the grooves 19. It is preferred, however, to use the transverse pairs 18 as shown in FIG. 2 since this reduces the possibility of warpage. Another advantage to using the pairs 18 is that when building dimensions or configuration, such as openings for doors or windows, require that a panel be cut at the construction site in the direction parallel to the transverse members, the line formed by the mating surfaces of strips 18' of any given pair 18 will serve as a guide, thus permitting relatively unskilled workmen using a simple hand or power saw to make a straight and accurate cut along the center line of the passage formed by the grooves 19.

One of the principal advantages of the building system of this invention is that the panels 10 as prefabricated and delivered to the building site are all identical in size and configuration. It is not necessary to provide prefabricated panels of various configurations and dimensions as is frequently required in the modular building systems. As is apparent from FIG. 2, as building dimensions and configuration might require, the panels 10 can be cut at any point along a line normal to the transverse pairs 18 so as to provide a subdivided panel having an edge configuration identical to the edge of the uncut panel. Similarly, each of the panels 10 can be subdivided or cut in the other direction, i.e. along any given center line of the passages provided by the transverse pairs 18, and again expose an edge identical to the parallel edge of the uncut panel. The panels 10 can thus be subdivided using simple hand or power tools at the construction site so as to provide flexibility in dimensioning the structure and to provide the necessary building openings for doors and windows.

As shown in FIG. 2, a fin 11 is positioned between each adjacent panel 10. Each of the fins 11 is preferably fabricated of mild steel so that the fins will have greater compression, shear and tensile strength than the panels 10. While the particular gauge of the steel used will be dictated by the strength requirements of the building, for one or two story residential structures one-eighth inch thick mild steel is generally adequate. Each fin 11 is provided with a series of large holes 20 positioned along the center line of the fin so as to be in alignment with and have the same circumference as the passages formed by grooves 19 of the pairs 18 of transverse members of the panels 10. In the preferred embodiment of this invention each fin 11 has a width greater than the thickness of panel 10 so that in their assembled relationship a portion of each fin 11 will extend beyond each surface of the panels. By way of example, for residential or light commercial construction a panel thickness of two inches and a fin width of four inches is generally used but these dimensions can be varied to suit the requirements of the structure.

A series of small holes 21, preferably uniformly spaced, are provided in the portions of the fins 11 which extend beyond the surface of the panels 10. The holes 21 facilitate attachment of auxiliary strengthening members 22 which are preferably thin strips of steel and are employed to augument the strength of the fins, for example, as is necessary between rows of panels as illustrated in FIG. 2. The holes 21 also permit the attachment of channel-shaped finishing members 23 which fit over the portions of the fins which project beyond the surface of the panels. The finishing members serve to both seal the intersection of the panel and fin and to provide a finished appearance to the structure. While the dimensions of the holes 20 and 21 are not critical, when the building system of this invention is used to construct a residential structure of one or two stories in height, the large holes 20 will typically be three-fourths inches in diameter while the small holes 21 will be one-fourth inch in diameter. A generally semi-circular shaped notch 24 is provided at each end of fin 11 so as to coincide with the groove 19 in the single transverse member 18' positioned at the edges of the panel.

While it is preferred that each of the fins 11 have a width greater than the thickness of the panels 10, it will be obvious to one skilled in the art that not all of the fins positioned between adjacent panels need be so dimensioned. Fins to which auxiliary strengthening members 22 are not attached and fins of a wall which are not employed for attachment to other portions of the structure, such as the floor or ceiling, need not be of greater width than the panel thickness. In order, however, to realize the cost and convenience advantages of a modular building system in which multiples of like elements are prefabricated and used to erect the structure all fins 11 should be identical and interchangeable in the system.

As shown in FIG. 2, load transferring members 12, which preferably are short lengths of metal pipe, are positioned in various of the holes 20 of the fins 11. When positioned such that the particular load transferring member 12 will not have to provide an opening or passage for the integrating means 13, the member 12 need not be hollow and can be in the form of a short length of metal rod. The load transferring members 12 are sized so as to have a snug fit in the holes 20 of the fins and also are of a suitable length so as to project partially into the passages provided by the pairs 18 of transverse members 18' of each adjacent panel 10. The grooves 19 in each of the members 18' are also sized so that the load transferring members 12 will have a snug fit in the passages provided by the pairs 18. In this manner when the panels 10 and fins 11 are in their assembled relationship in a building as shown in FIG. 1. Load transferring members 12 will serve to give rigidity to the structure and transfer shear load from the panels 10 to the fins 11.

As shown in FIG. 2, an integrating means 13 is positioned within several of the passages of the panels 10 provided by the pairs 18 of transverse members 18' and likewise passes through the load transferring members 12 positioned in the fins 11. In the preferred form of the invention, flexible metal cable or stranded wire rope is used as the integrating means 13, although a metal rod can be used. As will be explained hereinafter, each integrating means is firmly anchored at the end of a series of panels forming a wall, for example, and after the wall is assembled each integrating means is placed in tension (sometimes referred to as post-tensioning) and firmly held in a state of tension at the ends of the wall by anchoring members hereinafter described. In this manner the panels 10 and fins 11 are placed under compression so as to form, in cooperation with load transferring members 12, a strong integrated wall structure. The number of integrating means used for a wall or for a series of panels forming a section of a floor, ceiling or roof structure will vary depending on the size of building and the strength requirements of the structure. In one or two storied residential buildings a minimum of two integrating means 13 for each row of panels in each load bearing wall should be employed. As shown in FIG. 1, when a wall is provided with an opening such as a door, the integrating means 13 intersecting the opening are anchored at the frame of the door and extend to the adjacent end of the wall. Similarly, it is not necessary to provide a load transferring member 12 in each hole 20 of the fins. In normal practice, however, it is preferred that a multiple of load transferring members be inserted in each fin as shown in FIGS. 1 and 2, and for maximum strength a load transferring member 12 would be inserted in each of the holes 20 in fins 11 positioned between adjacent panels 10.

As shown in FIG. 2 when the wall is to have a height equivalent to the height of two or more panels 10, a load transferring member 12' is positioned between the abutting edges of the "stacked" panels 10. The load transferring member 12' thus functions as a spline to provide shear stability to the wall and, like members 12, is conveniently a length of metal pipe. Load transferring members 12' have a length somewhat less than the width of the panels 10 as shown in FIG. 2, and have a snug fit in the circular passage provided by the grooves 19 in the single transverse members 18' at the edges of the panels 10 when the wall is fully assembled.

In describing FIG. 1 above it was mentioned that the facade of the building between the wall and the pitched roof is formed by cutting several panels 10 at appropriate angles to provide subdivisions 14, 15, 16 (see FIG. 1) of the basic panel. This operation would normally be performed at the construction site. After the panels are thus subdivided wood strips indentical to the strips 18' of FIG. 2 are secured between the skins 17 of the panel along the angle of the cut so as to provide the angular edge of the subdivided panels which engage the fins 11 of the roof adjacent the pitched ends of the roof.

Figure 3:
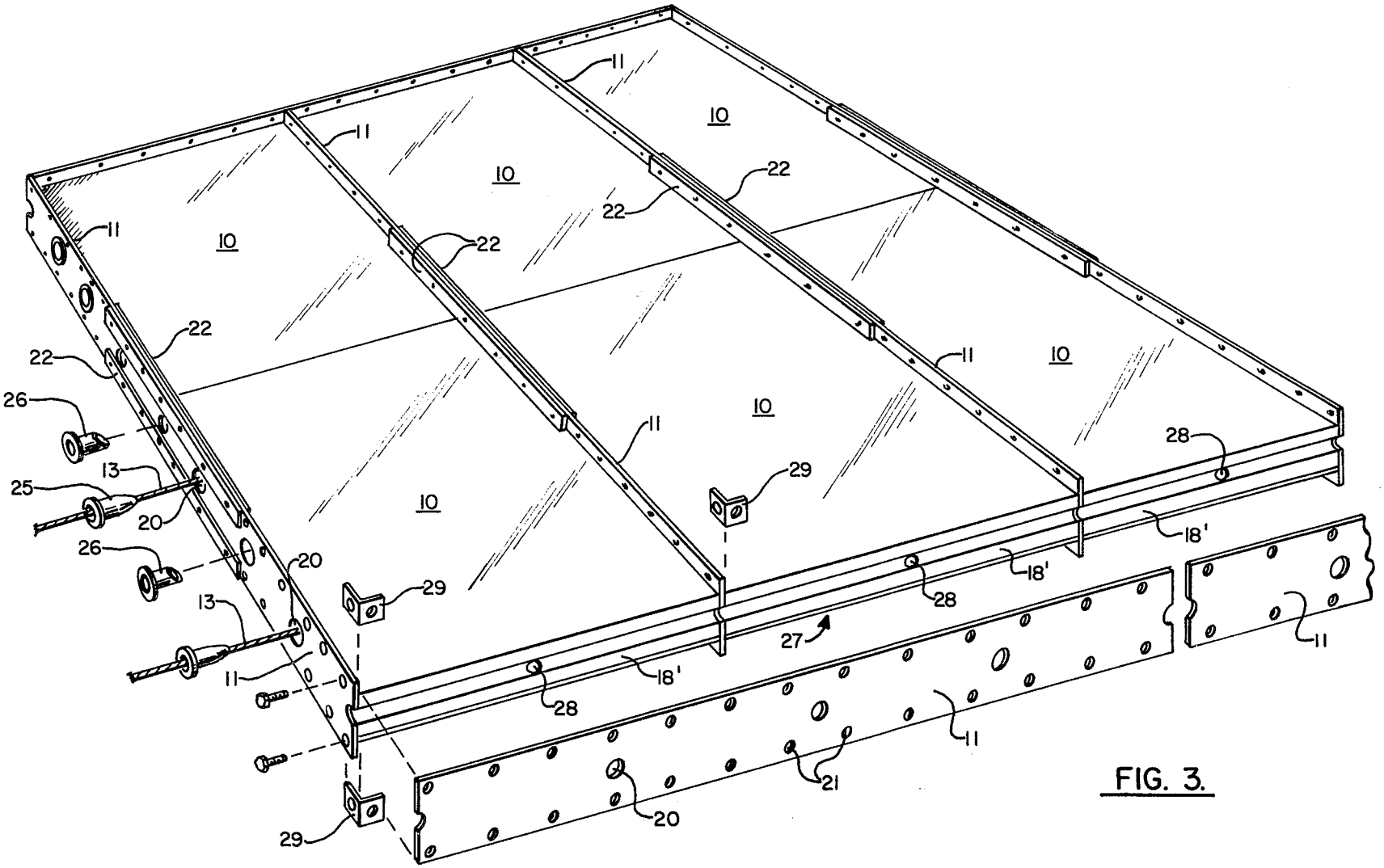
FIG. 3 is a perspective view illustrating the manner in which two or more rows of panels are assembled to form a floor, ceiling, or one plane of a pitched roof of a building constructed in accordance with this invention.

FIG. 3 shows the manner in which the building system of this invention is used to construct a floor, ceiling or one plane of a pitched roof in which a distance greater than the longest dimension of a panel 10 must be spanned. As shown in FIG. 3 two rows of panels 10 are arranged in an end-to-end abutting relationship. The individual panels 10 and fins 11 of each row are assembled in the manner shown for a wall section in connection with FIG. 2. It is to be understood that load transferring members 12 and 12' are positioned as shown in FIG. 2 so as to provide the shear strength required. Auxiliary strengthening members 22 are secured to the aligned fins 11 of the abutting rows of panels in the manner indicated. Auxiliary strengthening members 22 are preferably strips of mild steel having small holes punched therein of the same size and center line distance as the small holes 21 of the fins 11 as shown in FIG. 2 so as to permit attachment thereto by bolts. By attaching auxiliary strengthening members 22 as shown in FIG. 3 a strength "continuation" of the fins 11 is achieved. By providing members 22 of a length approximating twice the length of the fins 11 and attaching such members 22 to both sides of the fins and to the portions of the fins projecting beyond both the upper and lower faces of the panels 10, it is possible to simulate the strength effect of an "I" beam. In this manner, the strength characteristics of the fins can be modified to meet the requirements of the structure.

FIG. 3 shows the manner by which the integrating means 13 are anchored and held in tension. For this purpose it is convenient to use as the anchoring members 25 a cable retaining device of the type disclosed in U.S. Pat. No. 2,138,913. In operation the ends of the integrating means are inserted through the tapered end of the anchoring members 25 and the member 25 tapped into the hole 20 of the fin. This operation is performed at each end of the row of panels forming the floor, wall, ceiling or roof plane as the case may be. Tension is then applied at one end of each integrating means and the internal construction of the anchoring members 25 permits the integrating means to be pulled in a direction away from the row of panels while preventing movement of the integrating means in the direction of the row of panels. As the tensioning tool one can use any cable or wire pulling device which applies a resisting force to the member 25 while at the same time applying a pulling force to the integrating means. In this way each integrating means is placed in and held in a state of tension thus placing and holding the panels 10 and fins 11 in a fixed state of compression.

While it is preferred to use metal cable or stranded wire rope as the integrating means 13 as illustrated in FIG. 3, metal rods can also be used in which case the ends of the rods are threaded and nuts are applied and tightened at each projecting end of the rod to place the rod in tension and hold the panels and fins in compression. When using metal cable or wire rope as the integrating means 13 one may , if desired, use one continuous length of cable or rope threaded back and forth through the panels 10 for two or more passages with anchoring members 25 used only at the two ends of the thus formed loop of the integrating means. In this manner it is possible to assure a uniform tension of the integrating means for a given row of panels and also reduce the time required to post-tension a structure.

As shown on FIG. 3, hollow flanged nails 26 are used to assist in securing the end fins to the terminal panel of a row of panels. The passages within the panel provided by the transverse members 18' (see FIG. 2) are aligned with the holes 20 in the fin, and in those holes 20 not used to accommodate the integrating means 13 the hollow nails 26 are inserted and frictionally engage the transverse members 18'. When one or more rows of panels are to form a floor or ceiling it is preferable to secure a fin 11 at each end of the assembled panels as illustrated in exploded form at the end 27 of FIG. 3. Attachment of the fin is accomplished by holes 28 which are bored in the transverse member 18' to align with holes 20 in the fins so as to permit insertion of the hollow nails 26 through the holes 20 and into frictional engagement with the panel at bored holes 28. Additional attachment of the end fin to the intersecting fins is by means of angle brackets 29 which are secured by bolts.

Figure 4:
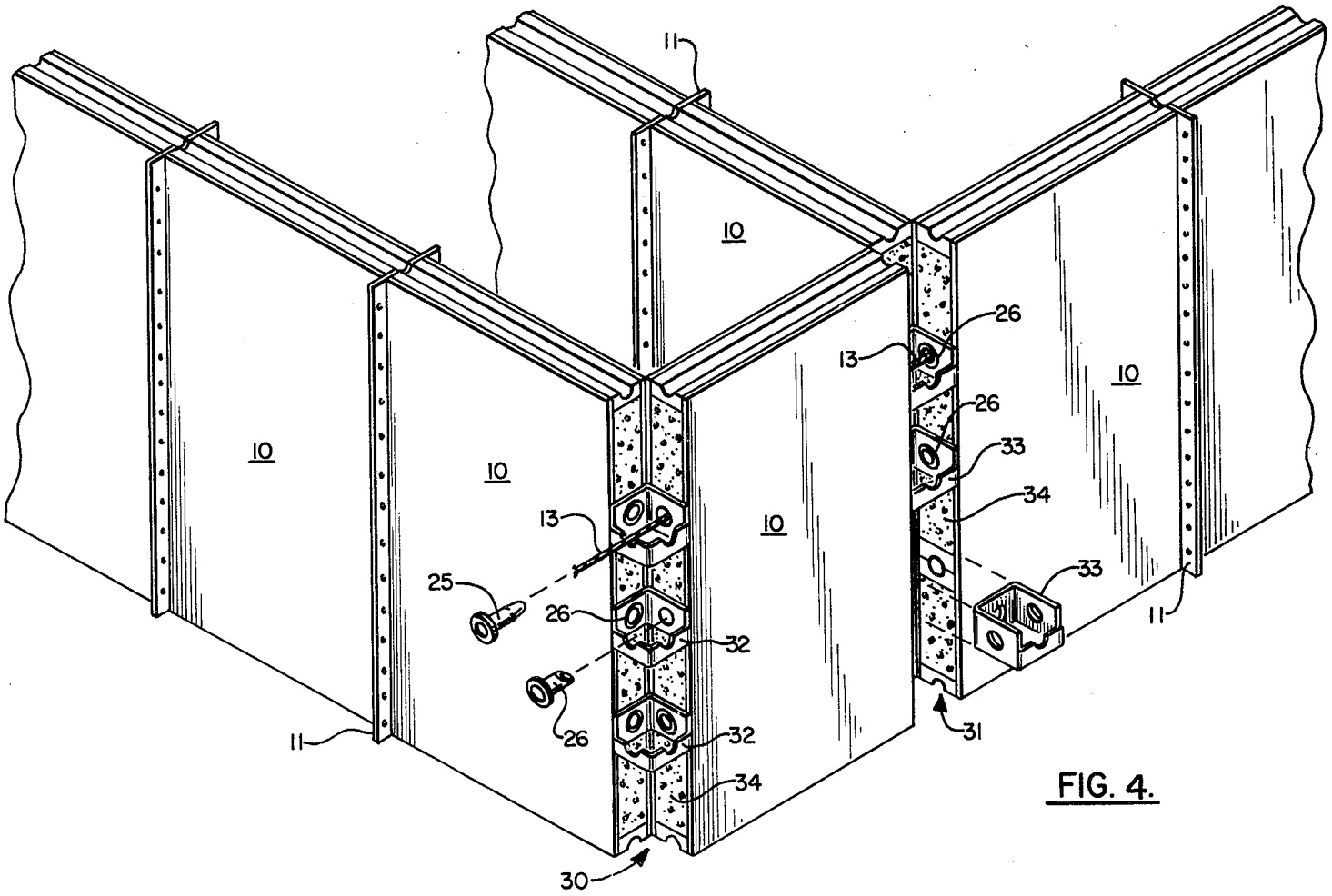
FIG. 4 illustrates the preferred means for anchoring the integrating means at the end of a series of panels forming a wall and also illustrates the manner in which intersecting walls are secured to each other.

FIG. 4 shows the manner in which intersecting walls of a building constructed in accordance with this invention are joined. Each of the panels 10 interesecting at the corner indicated at 30 will have been cut at the construction site along a line normal to the transverse members 18' (see FIG. 2) so as to remove a segment equal to one-half the thickness of the panel. Similarly, each of the three panels 10 intersecting at 31 where an interior wall intersects an exterior wall at an intermediate point along the length of the exterior wall will have been similarily cut so as to remove a segment equal to one-half the thickness of the panel. The reason for cutting the intersecting panels in this manner is that all panels 10 as constructed and delivered to the construction site are of identical dimensions. These dimensions represent the module unit for all basic elements of the structure, i.e., the walls, floors, ceiling and roof. Since a module unit in the horizontal direction is the width of the panel, the above described segments are removed from the intersecting wall panels so that the associated floor structure and ceiling structure will have proper closure at the points where the walls intersect. This will be more apparent from a consideration of FIGS. 5 and 6 described hereinafter.

As shown in FIG. 4 the intersecting walls are joined and assembled with the use of steel cubes 32 and 33. The steel cubes 32, which are used to attach intersecting walls at a corner of the structure, have two adjacent sides of the cube larger than the other two sides of the cube, with each cube face being punched or bored as indicated so as to be secured in place by means of the anchoring members 25 and the hollow nails 26. As illustrated in FIG. 4 the cubes 32 at the corner 30 are positioned so that the holes in the large sides of the cube are in alignment with the passages formed by the transverse members 18' (see FIG. 2) within the panels 10. The two adjacent smaller sides of the cubes 32 are notched as illustrated so as to facilitate insertion of the anchoring members 25 and the hollow nails 26. Cubes 33 which are used to attach an interior wall at its intersection with an exterior wall intermediate the length of the exterior wall, have three adjacent sides larger than the fourth side of the cube. The larger sides of the cubes 33 are punched or bored as indicated to permit insertion of the hollow nails 26 and to permit the passage therethrough of the integrating means 13. The smaller side of the cubes 33 is notched so as to facilitate insertion of the hollow nails 26 into the panels of the exterior wall and to permit the insertion of the anchoring members 25 into the intersecting end of the interior wall. Also as shown in FIG. 4 the voids within the panels 10 between the transverse members may be filled with an insulating material 34.

Figure 5:
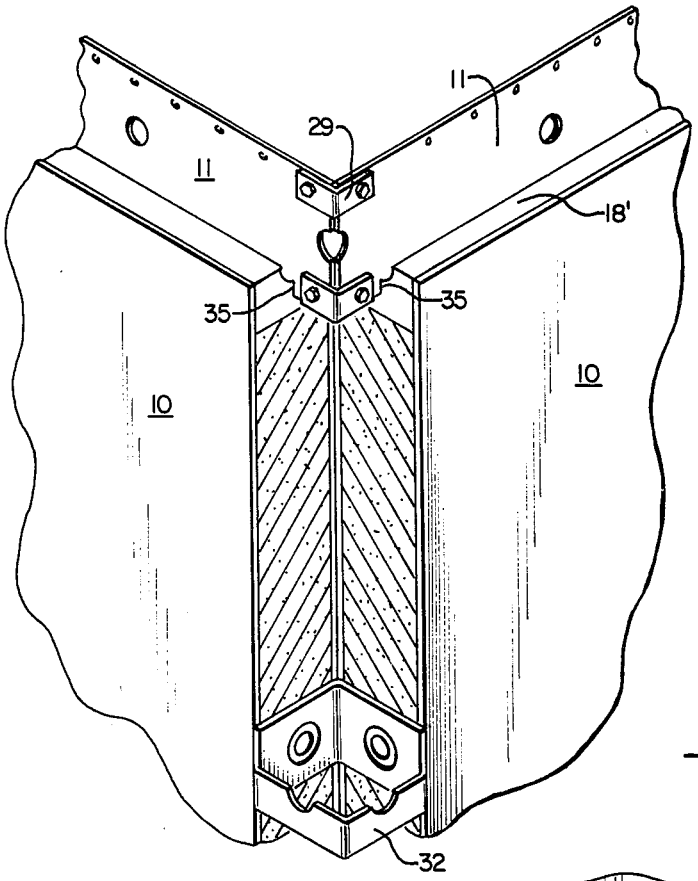
FIGS. 5 and 6 illustrate by fragmentary perspective views the manner in which intersecting vertical walls are joined to the edge fins of a ceiling and floor respectively.
Figure 6:
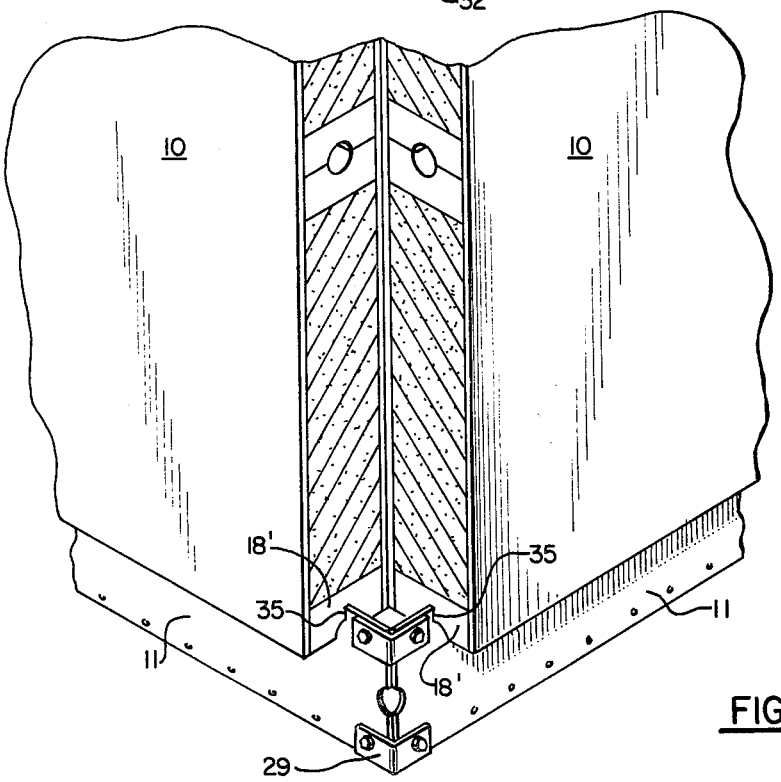

FIGS. 5 and 6 illustrate the manner in which a ceiling and a floor respectively, are attached to the walls of the structure. As indicated in FIG. 5, the edge fins 11 forming the perimeter of the ceiling nest in a slot 35 which is cut at the construction site in the top transverse member 18' of the panels 10. Similarly, as shown in FIG. 6, the edge fins 11 forming the perimeter of the floor nest in the slot 35 which is similarly cut in the bottom transverse member 18' of the panels 10. In order to accommodate the edge fins 11 forming the perimeter of the ceiling and the perimeter of the floor, the fins positioned between the panels forming the wall will also have a notch cut therein at each end of the fin coinciding with the slot 35 thus permitting the perimeter fins of the ceiling and floor to nest in the notches so cut in fins of the wall.

Figure 7:
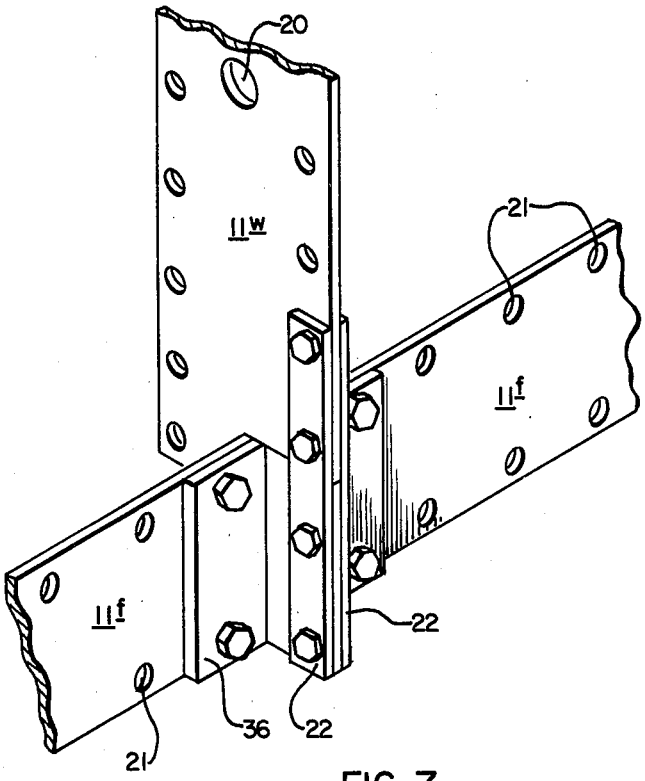
FIG. 7 is a fragmentary perspective view showing the manner in which the fins of an exterior wall are secured to the edge fins of a floor.

FIG. 7 is a detailed view illustrating a preferred method of attaching the perimeter fins 11*f* of a floor to the fins 11*w* interposed between the panels of an exterior wall. For clarity the panels are not shown in FIG. 7. To make this attachment a "T" bracket 36 is secured by bolts as indicated to the floor fins 11*f*. Short lengths of auxiliary members 22 are bolted to the projecting portion of the "T" bracket 36, the members 22 in turn being bolted to the projecting portions of the wall fin 11*w* as indicated. To make this attachment the bottom portion of the wall fin 11*w* is notched to accommodate the projecting portion of the "T" bracket and this can be done using hand tools at the construction site. This same method of attachment is also preferably used for securing the perimeter fins of a ceiling to the vertical fins of an exterior wall using the same arrangement of "T" bracket 36 and members 22.

As previously described in connection with FIG. 3, each plane or pitch of the roof structure is assembled in the same manner as that described for a floor or ceiling. Referring to FIG. 1, the fins 11 of the roof are attached to the perimeter fins of the ceiling by means of small angle braces 37. The fins 11 of each intersecting pitch of the roof are secured to each other at the apex of the roof by means of metal plates (not shown), again the attachment being made by means of bolts through the small holes 21 in the portions of the fins which project beyond the surface of the panels. The front overhang portion 38 of the roof (see FIG. 1) is formed by merely cutting one or more panels 10 in the direction normal to the transverse members 18' (see FIG. 2), to provide a panel segment of the desired dimension. The integrating means 13 of each roof pitch are anchored at the outer edge of this overhang portion of the roof by means of the anchoring members 25, and in this instance a metal washer or plate having an opening therein to accommodate the anchoring members 25 is interposed between the flanged portion of the anchoring members and the edge of the panel.

When erecting a structure in accordance with the modular building system of this invention the floor components as described in connection with FIG. 3 are first assembled over a grillage of piers as is common practice in building construction. The floor structure is attached to the piers by bolting the lower projecting portions of the floor fins 11 to the piers. The walls are then assembled by first cutting a slot 35 (see FIGS. 5 and 6) in the bottom and top transverse members 18' of the panels and this is done at the construction site. The wall sections are then erected upon and secured to the floor as described in connection with FIGS. 6 and 7, and the intersecting walls attached as described in connection with FIG. 4. The ceiling is assembled as described in connection with FIG. 3, and is placed upon and supported by the wall structure. If the building is to have a pitched roof, each pitch of the roof is assembled in a similar manner and the fins of the roof, by means of metal plates (not shown), are secured to the fins of the exterior wall and to the peripheral fins of the ceiling as previously described. As each segment (floor, wall, ceiling and roof pitch) is completed, multiple integrating means 13 are inserted through the length of the segment, anchored at the ends and post-tensioned as previously described.

Figure 8:
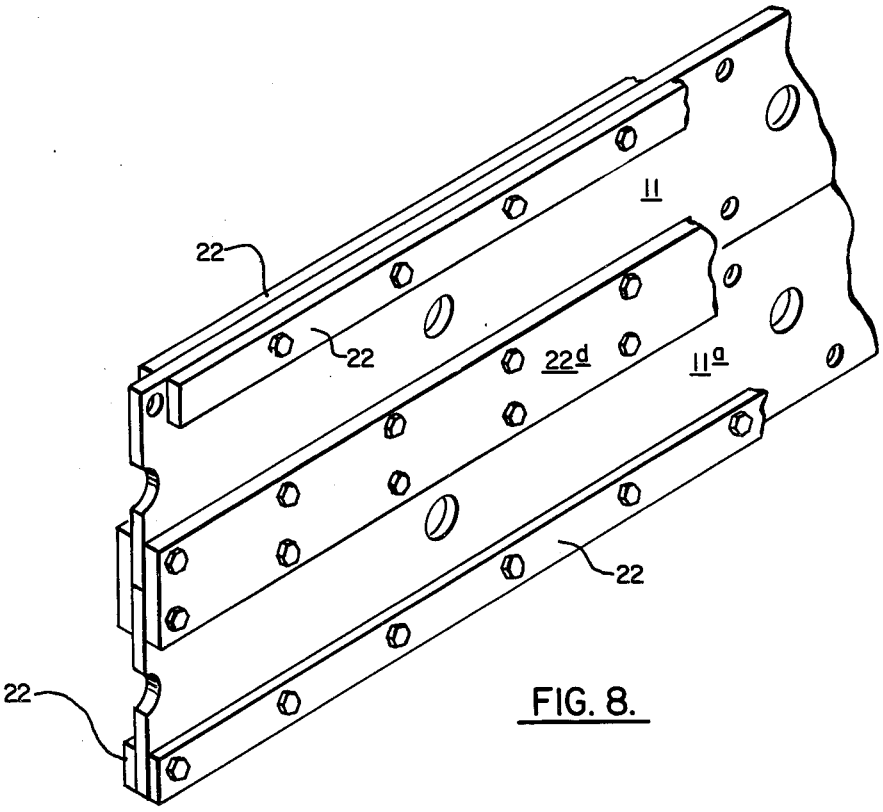
FIG. 8 illustrates by fragmentary perspective view the manner in which fins may be joined to gain additional strength such as may be desired in a floor.

One of the unique advantages of the system of this invention is that by attaching auxiliary strengthening members 22 to the fins 11 one can augment the strength of the fins as the requirements of the building may dictate. FIG. 8 illustrates one particular combination of fins 11 and auxiliary strenghtening members 22 which can be utilized to add strength to a heavy load bearing floor. Referring to FIG. 8, an additional fin 11*a* is attached as indicated to the portions of a floor fin projecting below the bottom surface of the panels forming a floor. This is accomplished by means of a double width auxiliary strengthening member 22*d* which by means of bolts attaches the additional fin to the projecting portions of the floor fin. Other combinations of fins 11 and members 22 can be employed to in effect "continue" or extend the strength of the fins 11.

It is within the scope of this invention to construct a building in which only certain segments of the structure utilize the modular system herein described. For example, if the building is to be constructed on a concrete pad, the pad will be poured with an appropriate step around the periphery of the pad with tie bolts set in the step projecting horizontally. A series of fins 11 are then bolted to these tie bolts and the vertical exterior walls erected upon and secured to these perimeter fins in the manner described in connection with FIG. 6 and 7.

Referring to FIG. 1, it will be seen that the exterior of a building constructed in accordance with this invention will consist of a series of panels 10 with portions of fins 11 projecting beyond the surface of the panels. If desired finishing members 23 (see FIG. 2) may be secured to the projecting portions of the fins of the walls so as to give the finished appearance of a post-and beam type construction. Like finishing members may also be secured over the corners of the building. After attaching such finishing members it is desirable to seal the intersections of panels and finishng members with standard caulking or sealing materials. The roof is finished in a conventional manner by applying flashing over the projecting portions of the fins or insultating flush with the top of the fins, and then applying roofing felt and shingles.

It can thus be seen that the modular building system of this invention offers advantages over many existing prefabrication systems which usually require large central assembly plants producing a variety of large modules and components which are difficult to transport and necessitate the use of heavy equipment at the construction site for assembly. In contrast, the system of this invention uses only a few, single-design, light weight, basic component parts—panels 10, fins 11, load transferring members 12, integrating means 13—all of which are easy to transport to the construction site and can be assembled by relatively unskilled labor using simple hand type power tools. The system also provides for maximum flexibility in the design shape and size of the building to be constructed since the panels 10 can be subdivided at the construction site to achieve whatever building dimensions are desired and assembled in both the horizontal and vertical direction, the latter by "stacking" the panels as illustrated in FIG. 2.

Figure 9:
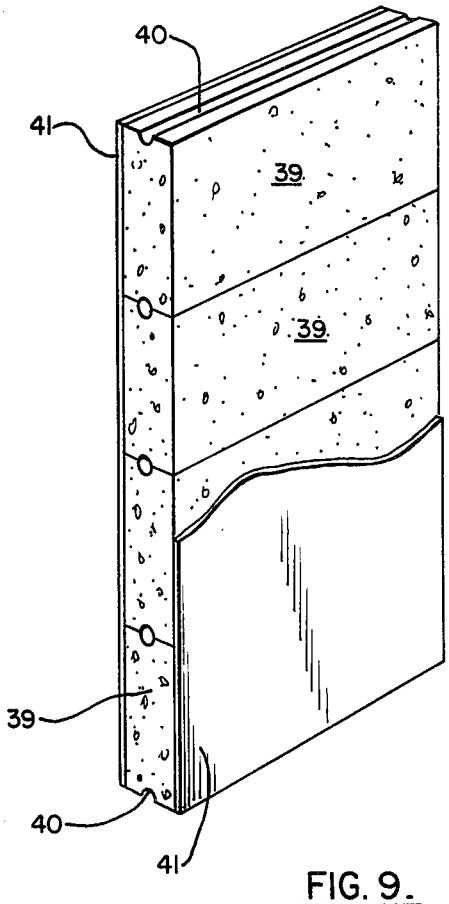
FIG. 9 is a perspective view, partially cut away, illustrating an embodiment of a panel which can be used when a fire resistant building is to be erected in accordance with this invention.

While the panels 10 have been described as being fabricated using plywood or fiberboard skins with the interior pairs 18 of transverse members (see FIG. 2) being wood, other construction materials can be used. FIG. 9 illustrates another embodiment of the panel of this invention. Referring to FIG. 9, the core of the panel consists of a series of transverse members 39 which are pre-cast from light weight concrete or other light weight cementitious type material. The core members 39 as cast are provided with a generally semi-circular groove 40 upon two opposite edges. In their assembled relationship as shown in FIG. 9 the grooves 40 provide a passage from one side of the panel to the other so as to accommodate the load transferring members and the integrating means as previously described. The skins 41 of the panel shown in FIG. 9 are fabricated of cement asbestos board, such that when a building is constructed utilizing such panels a fire resistant structure is obtained. The panels may also be formed of a single component, such as by casting light weight concrete, in which case the interior horizontal passages are either formed as the panel is cast in the mold or drilled after the panel is set and removed from the mold.

The building shown in FIG. 1 is merely illustrative of the type structure which can be erected using the modular building system of this invention and, as will be apparent to those skilled in the art, the system of this invention can be utilized to erect buildings of various sizes, shapes and degrees of complexity without departing from the spirit of this invention.

I claim:

1. A building having an exterior wall structure which comprises:

(a) a series of like panels and sub-divisions thereof, each of which has a plurality of defined internal horizontal passages with said passages of adjacent panels being in alignment; said panels capable of being subdivided along any line normal to said passages to provide a subdivided panel having an edge configuration identical to the edge of the uncut panel;

(b) fins positioned between adjacent panels, said fins being constructed of material having greater shear strength than said panels and having openings therein in alignment with said passages;

(c) load transferring members positioned in a plurality of said openings in said fins, each of said members extending partially into said aligned passages of said panels on each side of a fin; and (d) integrating means positioned in and extending through a plurality of said aligned passages and openings of said panels and fins respectively, each of said integrating means extending continuously through a plurality of said panels and fins and being anchored at each end thereof and maintained in state of tension so as to maintain said panels and fins under compression in the horizontal direction;

said building also having a ceiling and roof each of which comprises at least one row of panels with fins positioned between adjacent panels, said panels and fins being alike and interchangeable with said panels and fins of said wall structure and being held in assembled relation by a plurality of integrating means passing through aligned passages and openings in said panels and fins respectively, each of said integrating means being maintained in a state of tension and secured at opposite ends of said ceiling and roof respectively so as to maintain said panels and fins under compression, load transferring members positioned in a plurality of the openings in said fins and extending partially into said passages of the adjacent panels each of said fins having a width in excess of the thickness of said panels such that a portion of each of said fins extends beyond the surface of the panels, and auxiliary strengthening members secured to said portions of a plurality of said fins so as to augment the strength of the fins.

2. A building as set forth in claim 1 in which said ceiling comprises two or more rows of panels, said portion of a plurality of fins of each of said rows being joined by means of an auxiliary strengthening member to fins of the adjacent row so as to permit said ceiling to span a horizontal distance in excess of the longest dimension of each of said panels.

3. A building as set forth in claim 1 having a floor comprising two or more abutting rows of panels with fins positioned between adjacent panels of each row, said panels and fins being alike and interchangeable with said panels and fins of said wall structure and being held in assembled relation by a plurality of integrating means passing through aligned passages and openings in said panels and fins respectively, each of said integrating means being maintained in a state of tension and anchored at opposite ends of said floor so as to maintain said panels and fins under compression, load transferring members positioned in a plurality of the openings in said fins and extending partially into said passages of adjacent panels, said fins having a width in excess of the thickness of said panels such that portions of each of said fins extend beyond both the upper and lower surface of said panels, and auxiliary strengthening members secured to and overlapping said portions of at least two aligned fins of abutting rows.

4. A panel adapted for use in constructing a building comprising spaced-apart skin members secured to multiple pairs of transverse members of uniform cross sectional configuration positioned between said skin members and extending between two opposite edges of the panel, the members of each pair being positioned in a mating interfacial relationship, the face of each transverse member interfacing with the other having a generally semi-circular groove extending the length of the member such that each pair of transverse members defines a generally circular interior passage extending between said two opposite edges of the panel and such that when the panel is subdivided in a direction normal to the direction of said passage the exposed edge of the subdivided panel will be identical in cross section to said two opposite edges.

5. A panel as set forth in claim 4 in which the pairs of transverse members defining passages between two opposite edges of the panel are positioned within the panel such that the distance between the center lines of adjacent passages are equal.

* * * * *